US010005200B2

(12) United States Patent
Henry et al.

(10) Patent No.: US 10,005,200 B2
(45) Date of Patent: Jun. 26, 2018

(54) APPARATUS AND METHOD FOR REMOVING HOLES IN PRODUCTION OF BIOCOMPOSITE MATERIALS

(71) Applicant: CNH Industrial Canada, Ltd., Saskatoon (CA)

(72) Inventors: James Henry, Saskatoon (CA); Satyanarayan Panigrahi, Saskatoon (CA); Radhey Lal Kushwaha, Sakatoon (CA)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 515 days.

(21) Appl. No.: 14/640,453

(22) Filed: Mar. 6, 2015

(65) Prior Publication Data

US 2015/0253080 A1 Sep. 10, 2015

Related U.S. Application Data

(60) Provisional application No. 61/948,944, filed on Mar. 6, 2014.

(51) Int. Cl.
*F26B 5/04* (2006.01)
*B27N 3/00* (2006.01)

(52) U.S. Cl.
CPC ..... *B27N 3/00* (2013.01)

(58) Field of Classification Search
CPC ..... B27N 3/00; F26B 13/001; F26B 11/049; F26B 17/128; F26B 13/002
USPC ..... 34/402, 405, 413, 443, 444, 445, 452, 34/486, 493, 495, 558
See application file for complete search history.

(56) References Cited

U.S. PATENT DOCUMENTS 3,601,856 A 8/1971 Harris et al.
5,310,600 A 5/1994 Kazuhide et al.
5,424,388 A * 6/1995 Chen ..... B29C 70/521 264/136
5,598,642 A * 2/1997 Orloff ..... D21F 3/0272 162/206

(Continued)

FOREIGN PATENT DOCUMENTS

JP 2008200946 9/2008
WO 2012004865 1/2012

OTHER PUBLICATIONS

PCT/IB2015/000289, International Search Report and Written Opinion, dated Jul. 16, 2015, 9 pages.

*Primary Examiner* — John McCormack
(74) *Attorney, Agent, or Firm* — Rebecca L. Henkel; Rickard K. DeMille

(57) ABSTRACT

A system or apparatus and associated method is provided to remove pinholes from bio composite materials in order to increase the strength and functionality of the composites. The apparatus and method uses an inert gas, such as nitrogen, that is introduced into the processing chamber where the fiber and the polymer are combined to form the biocomposite material. The inert gas is introduced through an inlet into the chamber and creates a pressure differential between the interior and exterior of the product mixture to force the air and moisture out of the mixture and through an outlet or vent on the chamber, along with the inert gas and any other gases, thereby preventing or at least significantly limiting the formation of pinholes in the biocomposite product.

15 Claims, 1 Drawing Sheet

(56) References Cited

U.S. PATENT DOCUMENTS

| | | | | |
|---|---|---|---|---|
| 5,785,110 | A | 7/1998 | Guergov | |
| 6,292,613 | B1 * | 9/2001 | Fort | C03C 25/1065 385/128 |
| 2005/0081588 | A1 | 4/2005 | Twigg et al. | |
| 2005/0220921 | A1 | 10/2005 | Olsson | |
| 2006/0251838 | A1 | 11/2006 | Inoue et al. | |
| 2007/0039199 | A1 * | 2/2007 | Whitman | A47K 10/48 34/443 |
| 2007/0039872 | A1 | 2/2007 | Tada et al. | |
| 2007/0063369 | A1 | 3/2007 | Byrne | |
| 2011/0290136 | A1 | 12/2011 | Koga | |

* cited by examiner

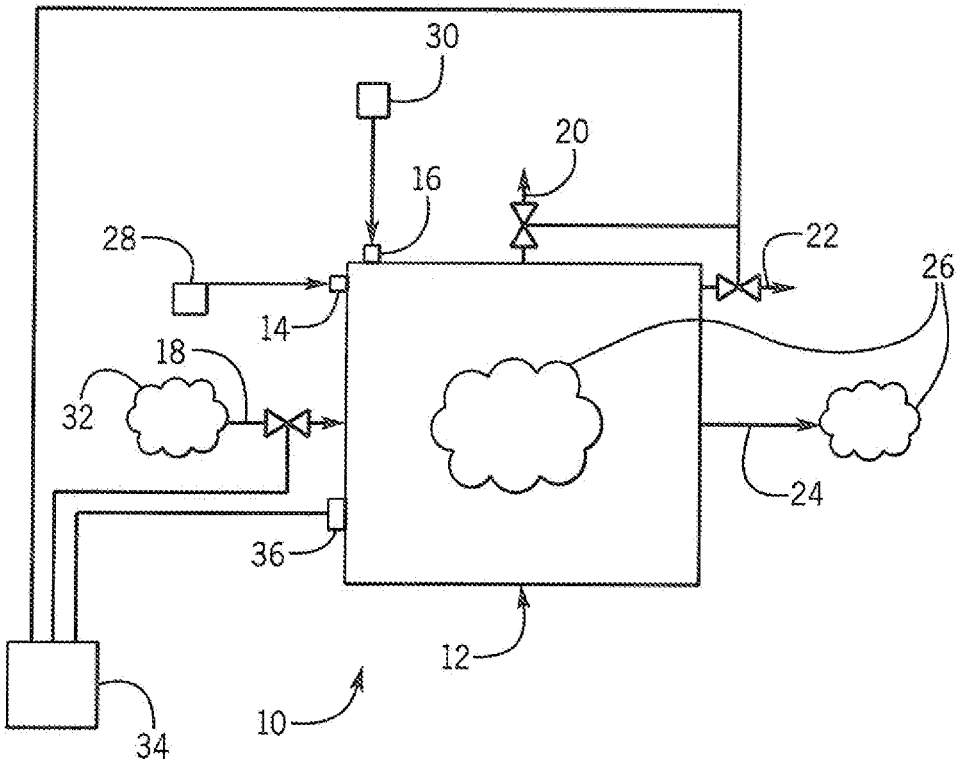
30
20
16
28
22
26
14
18
32
24
36
12
10
34

APPARATUS AND METHOD FOR REMOVING HOLES IN PRODUCTION OF BIOCOMPOSITE MATERIALS

CROSS-REFERENCE TO RELATED APPLICATIONS

This application claims priority from U.S. Provisional Patent Application Ser. No. 61/948,844 filed on Mar. 6, 2014, the entirety of which is expressly incorporated herein by reference.

FIELD OF THE INVENTION

The subject matter disclosed herein relates generally to biocomposite materials and, in particular, to an apparatus or system and method for the reduction and/or removal of pin holes in biocomposite materials formed during their production in order to increase the strength and functionality of the biocomposite.

BACKGROUND OF THE INVENTION

Fibrous materials such as straw from flax, sisal, hemp, jute and coir, banana, among others, are used in the formation of biocomposite materials, where the fibrous material is combined with another compound(s), such as a polymer or blend of polymers. The fibrous materials can be in the form of raw fibrous materials, or fibers selected from the components of the raw fibrous material, such as the cellulose fibers once separated from the hemicelluloses, lignin and impurities components of the raw fibrous materials.

Once the fibers, such as from flax, hemp, jute, coir, sisal and banana among other sources, are cleaned, and processed, they are combined with polymers to make biocomposite products. However, during this manufacturing stage for the biocomposite materials, in conventional systems and methods, air, other gases and moisture are trapped inside the resulting biocomposite product. This air and moisture retained in the biocomposite material create pinholes in the biocomposite product formed from the material. In particular, pinholes are air and moisture pockets formed during the processing of the biocomposite product development, when processed fiber is blended with polymer materials, that can expand such as when subjected to heat and pressure during extraction/injection molding process to form the biocomposite materials. These pinholes render the resulting biocomposite material quite porous, which significantly weakens the resulting biocomposite product.

As a result, an apparatus or system and method for reducing or removing the air and moisture present in the biocomposite material, and consequently the pores or pinholes formed in the biocomposite product formed from the biocomposite material in order to increase the strength and durability of biocomposite products is needed.

SUMMARY OF THE INVENTION

According to one aspect of an exemplary embodiment of the present disclosure, a system or apparatus and associated method is provided to remove pinholes from biocomposite materials in order to increase the strength and functionality of the biocomposites. The apparatus and method uses an inert gas, such as nitrogen, that is introduced into the processing chamber, which can be the chamber where the fiber and the polymer are combined to form the biocomposite material or the chamber in which the biocomposite material is formed into the biocomposite end product. The inert gas is introduced through an inlet into the chamber and passes into the mixture of the fiber and polymer to for a pressure differential within the chamber to force the air and moisture out of the mixture through an outlet, along with the inert gas and any other gases, to remove any pinholes in the final biocomposite product.

According to another aspect of an exemplary embodiment of the present disclosure, the apparatus, system and method optimizes the residence time of the biocomposite raw materials in the processing chamber during the material formation or molding processes to provide a biocomposite product with improved properties, including enhanced strength.

These and other objects, advantages, and features of the invention will become apparent to those skilled in the art from the detailed description and the accompanying drawings. It should be understood, however, that the detailed description and accompanying drawings, while indicating, preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawing furnished herewith illustrates a preferred construction of the present disclosure in which the above advantages and features are clearly disclosed as well as others which will be readily understood from the following description of the illustrated embodiment.

In the drawing:

The FIGURE is a schematic view of an exemplary embodiment of an apparatus constructed according to the present disclosure.

DETAILED DESCRIPTION OF THE INVENTION

With reference now to the drawing FIGURE in which like reference numerals designate like parts throughout the disclosure, a system or apparatus provided for forming a biocomposite material product from various types of fibers and or fibrous materials and various types of polymers is illustrated generally at 10. This apparatus, system and method is related to the processes disclosed in co-owned and co-pending U.S. patent application Ser. No. 14/087,326, filed on Nov. 22, 2013, the entirety of which is expressly incorporated by reference herein.

In the illustrated exemplary embodiment, the system 10 includes a processing chamber 12 which in the illustrated embodiment is formed as a mold in a suitable molding process, such as an injection or extrusion molding process. The chamber 12 includes a fiber inlet 14, a polymer inlet 16, a gas inlet 18, a gas outlet 20, a vent 22 and a product/material outlet 24. In the method, the processing chamber 12 is utilized to apply sufficient heat and pressure to the fiber and polymer introduced into the chamber 12 to form the biocomposite material or product 26 that exits the chamber 12 through the product outlet 24. Alternatively, instead of a product outlet 24, the chamber 12 can be formed as an openable structure, such as a mold having separable halves or portions, in order to enable the biocomposite product 26 formed therein to be removed from the chamber 12, such as in an injection molding process. Further, the chamber 12 can be a chamber utilized to form the biocomposite material by mixing the selected polymer(s) and fiber(s) therein, with the product exiting the chamber 12 through the outlet 24 being the biocomposite material.

In operation, the fibrous material 28, of any suitable type, and the polymer 30, of any suitable type, are introduced through the respective inlets 14 and 16 into the chamber 12, which can be any suitable type of chamber, such as a barrel extruder for an extrusion process or a mold for an injection molding process. The fiber or fibrous material 28 and the polymer 30 are subjected to temperatures and pressures within the chamber 12 as are known in the art to form them into the biocomposite material/product 26 having the desired shape as defined at least in part by the shape of the interior of the chamber 12. The fibrous material 28 and polymer 30 can also optionally be mixed along with the application of pressure and heat to form the material 26.

During the biocomposite material/product 26 manufacturing process within the chamber 12, an inert gas 32, for example, nitrogen, helium, or argon gas, among other suitable inert gases, is introduced through the gas inlet 18 into the chamber 12. An inert gas 32 is selected due to its ability to interact mechanically with the fiber 28, the polymer 30 and/or the product 26, and in a non-chemically reactive manner, so as not to affect or alter the composition of the biocomposite product 26 or its components. The gas 32 is introduced at a regulated temperature and/or pressure to develop and maintain a pressure difference in the processing chamber 12, i.e., between the interior and exterior of the molten biocomposite material (fiber/polymer) mass within the chamber. This pressure difference acts on the product mass 26, such as by compressing the mass 26, and forces the air and moisture out of the product 26 within the chamber 12.

This temperature and pressure for the incoming inert gas 32, as well as the flow rate, can be maintained through the use of a suitable controller 34 operably connected to the gas inlet 18, gas outlet 20 and vent 22, as well as to a sensor 36 disposed on the chamber 12 to continuously monitor the temperature and pressure differentials within the chamber 12. As the differential changes during the production process, the controller 34 can operate the inlet 18 to allow additional gas 32 at the necessary temperature and pressure to flow into the chamber 12, or the vent 22 to enable the gas 32 to escape from the chamber 12.

As the pressure differential generated by the gas 32 acts on the product 26, the gas 32 mechanically compresses the product 26 and forces the air and moisture within the product 26 out of the product 26 and out of the chamber 12 through the gas outlet 20. In one exemplary embodiment for the apparatus, system and method, the inert gas 32 is introduced into the chamber 12 and as to result it protects the degradation of fiber and reduces the melt temperature, while increasing the viscosity of the product/mass/material 26 and develop the necessary pressure in the chamber 12. The particular flow rate of the gas into the chamber 12 depends upon the chamber dimensions, processing conditions (including screw speed (rpm), diameter, residence time, and temperature, alone or in combination with one another, among other conditions) biocomposite material ingredients, fiber loading (%) of fiber, moisture content in the fiber, among other parameters. In one particular example, for a biocomposite formed with HDPE and 15% (w/w or v/v) fiber loading, 0.6 ml/min of inert gas was introduced to the chamber 12 during processing to achieve a pressure differential within the chamber 12 to remove the pinholes in the biocomposite product 26. The pressure differentials to be created within chamber 12 depend on type of polymer, fiber % and fiber moisture content of the product components, as well as the processing conditions or parameters within the chamber 12, such as those discussed previously, among other considerations. For example, the pressure differential between the interior and exterior of the product mass in the chamber 12 varies in the range of 1-20% of the chamber pressure for on a thermoplastic-based biocomposite with up to 30% w/w or v/v of fiber loading. Without introduction of the inert gas into the chamber 12, the normal pressure build up in the chamber 12 due to the processing and attributes of the biocomposite composition, for example, the fiber %, fiber moisture content, type of polymer and its moisture content, etc., allows any moisture and gases present in the composition to produce pores i.e., pin holes, in the biocomposite product 26. However, when the inert gas is directed into the chamber 12, the pressure differential created between the interior of the material (lesser pressure) and the exterior of the material (greater pressure) compresses the biocomposite material 26 to urge the moisture and gas present in the material 26 out of the material 26 to be carried away from the material 26 and vented out of the chamber 12 along with the inert gas, producing a non-porous, solid biocomposite material 26 without the pin holes.

In one exemplary embodiment, the residence time of the fiber 28 and polymer 30 within the chamber 12 is optimized to effectively remove all the air bubbles and moisture within product 26 during the processing under the pressure differential created by the introduction of the inert gas 32. Factors that affect the required residence time, and thus the size of any pinholes that would otherwise be formed in the product 26 include, but are not limited to: the particle size and shape of the fiber 28, the particle distribution of the fiber 28 within the polymer 30, the viscosity of the polymer 30, the surface tension at the chamber 12/polymer 30 interface, the temperature within the chamber 12, time, and the pressure within the chamber 12. In a particular exemplary embodiment, the volume of the inert gas introduced to the system/chamber 12 will be dependent upon the following:

1. Type of base polymer of biocomposite
2. Polymer processing temperature
3. Composition of fiber percentage in biocomposite formulation
4. Volume of materials (biocomposite formulation) processing per hours in the systems.

This determination can be done in real-time to provide an inert gas volume optimization for the system/chamber 12 by using heat and trail methods, as are known in the art, by employing the above four factors in those analyses. Further, in another particular exemplary embodiment, it is also contemplated to use a suitable model predictive control optimization-based control strategy for determine the volume of inert gas introduced to the system/chamber 12 using the above four variables as the inputs to the control strategy.

When the product 26 is formed with the inert gas 32 to remove the air and moisture from the fiber 28/polymer 30 mass or biocomposite mixture from which the product 26 is formed, the benefits to the resulting product include, but are not limited to: improved quality of the product 26, such as, but not limited to improved product 26 consistency, increased strength and durability of the product 26, reduced shrinkage at crystalline regions of the product 26, enhanced dimensional stability for the product 26, a reduction in the differential stress and residual stress of the product 26, and the ability to maintain the temperature gradient inside the chamber 12 during processing.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An apparatus for removing air and/or moisture from a biocomposite mixture including a fiber and a polymer during the formation of a product from the biocomposite mixture, the apparatus comprising:

a) a chamber capable of subjecting the biocomposite mixture to specified temperatures and pressures;

b) a gas inlet operably connected to the chamber;

c) a gas outlet operably connected to the chamber;

d) a regulator operably connected to the gas inlet; and e) a sensor operably connected between the regulator and the chamber to monitor the pressure differential within the chamber, wherein the regulator maintains a pressure differential in the range of 1-20% of the chamber pressure between an interior of the mixture and an exterior of the mixture.

2. The apparatus of claim 1 wherein the regulator is operably connected to the gas outlet.

3. The apparatus of claim 1 further comprising a gas supply operably connected to the gas inlet.

4. The apparatus of claim 3 wherein the gas supply is an inert gas supply.

5. The apparatus of claim 4 wherein the inert gas is selected from the group consisting of nitrogen, helium and argon.

6. The apparatus of claim 1 further comprising a vent operably connected to the chamber.

7. The apparatus of claim 6 wherein the regulator is operably connected to the vent.

8. The apparatus of claim 1 further comprising:

a) a material inlet; and b) a product outlet.

9. The apparatus of claim 8, wherein the material inlet comprises:

a) a fiber inlet; and b) a polymer inlet.

10. The apparatus of claim 1 wherein the chamber is a molding chamber.

11. A method for removing air and/or moisture from a biocomposite mixture during the formation of a product from the biocomposite mixture, the method comprising:

a) placing the biocomposite mixture within an apparatus comprising:

i) a chamber capable of subjecting the biocomposite mixture to specified temperatures and pressures;

ii) a gas inlet operably connected to the chamber;

iii) a gas outlet operably connected to the chamber, iv) a regulator operably connected to the gas inlet; and v) a sensor operably connected between the regulator and the chamber to monitor the pressure differential within the chamber, wherein the regulator maintains a pressure differential in the range of 1-20% of the chamber pressure between an interior of the biocomposite mixture and an exterior of the biocomposite mixture;

b) subjecting the biocomposite mixture to specified temperatures and pressures within the chamber;

b) introducing an inert gas into the chamber through the gas inlet to create a pressure differential within the chamber; and c) removing the inert gas, air and moisture from the chamber.

12. The method of claim 11 wherein the step of introducing the inert gas into the chamber comprises:

a) sensing the pressure differential within the chamber; and b) opening the gas inlet to allow the inter gas to flow into the chamber.

13. The method of claim 11 wherein the step of removing the inert gas, air and moisture from the chamber comprises opening a gas outlet to allow the inert gas, air and moisture to exit the chamber.

14. The method of claim 11 further comprising the steps of:

a) sensing the pressure differential within the chamber; and b) opening a vent operably connected to the chamber to allow the inert gas to exit the chamber.

15. The method of claim 11 further comprising the step of removing a product formed from the biocomposite mixture from the chamber after removing the inert gas from the chamber.

* * * * *